US006283661B1

(12) United States Patent
Connors

(10) Patent No.: US 6,283,661 B1
(45) Date of Patent: Sep. 4, 2001

(54) WRITING UTENSIL HOUSING A SUPPLY OF PAPER

(76) Inventor: Frank R. Connors, 8 Washington Dr., East Quogue, NY (US) 11942

( * ) Notice: Subject to any disclaimer, the term of this patent is extended or adjusted under 35 U.S.C. 154(b) by 0 days.

(21) Appl. No.: 09/707,014

(22) Filed: Nov. 6, 2000

(51) Int. Cl.[7] ..... B43K 29/00
(52) U.S. Cl. ..... 401/195; 401/52; D19/36
(58) Field of Search ..... 401/195, 52; D19/36

(56) References Cited

U.S. PATENT DOCUMENTS

| | | | | |
|---|---|---|---|---|
| D. 329,459 | * | 9/1992 | Sullivan | D19/36 |
| D. 393,280 | | 4/1998 | Cheng | D19/42 |
| 3,963,358 | | 6/1976 | Houser | 401/195 |
| 4,812,069 | | 3/1989 | White | 401/52 |
| 4,872,775 | | 10/1989 | Chang | 401/52 |
| 4,963,048 | | 10/1990 | Thomas et al. | 401/195 |
| 4,989,801 | | 2/1991 | Thomas et al. | 242/55.53 |
| 5,158,384 | | 10/1992 | Radmilovic et al. | 401/195 |

FOREIGN PATENT DOCUMENTS

| | | | | |
|---|---|---|---|---|
| 1043580 | * | 11/1953 | (FR) | 401/195 |

* cited by examiner

*Primary Examiner*—Gregory L. Huson
*Assistant Examiner*—Huyen Le
(74) *Attorney, Agent, or Firm*—Darby & Darby

(57) ABSTRACT

The writing utensil includes a generally elongated hollow housing having a first longitudinal slot, a second longitudinal slot and a third longitudinal slot. A roll of paper is rotatably mounted within the housing. The roll of paper has a leading edge that is threadable out of the housing through the first slot, back into the housing through the second slot, and out of the housing through the third slot so that a selective portion of the roll of paper is removable from the housing.

32 Claims, 2 Drawing Sheets

FIG. 1
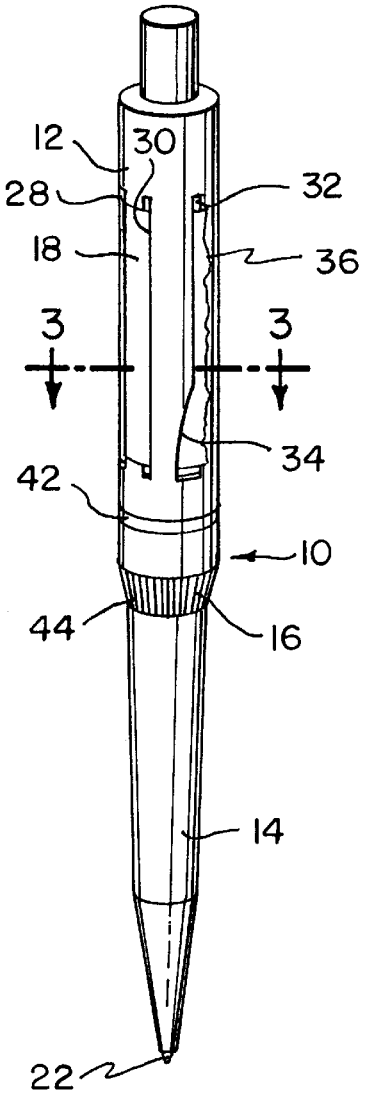
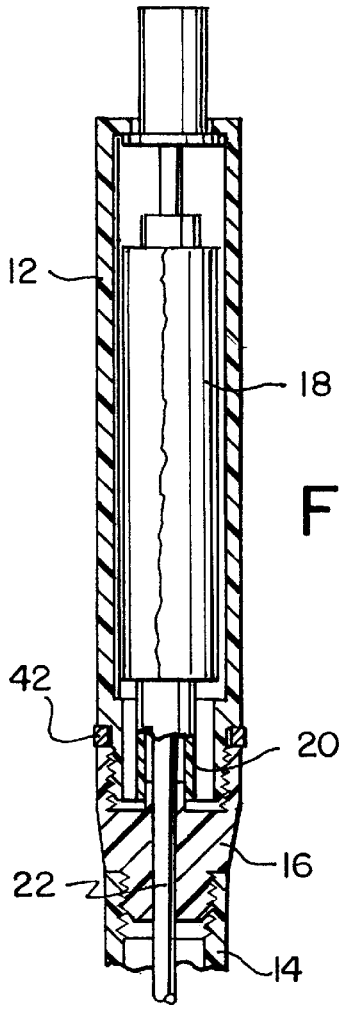
FIG. 2
FIG. 3
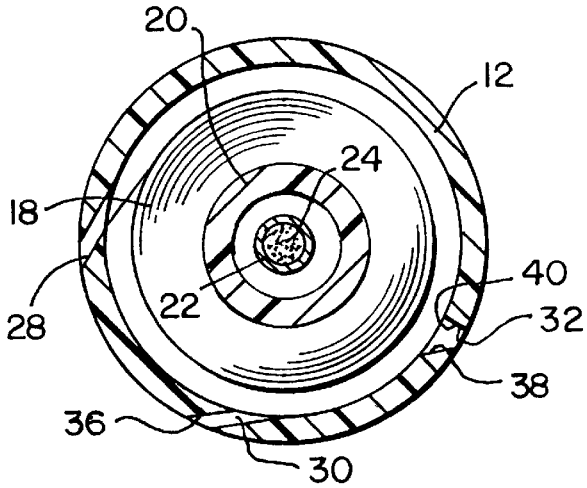

WRITING UTENSIL HOUSING A SUPPLY OF PAPER

BACKGROUND OF THE INVENTION

1. Field of the Invention

The present invention relates to a writing utensil that houses a supply of paper. More specifically, the present invention relates to a writing utensil having a housing having a first slot, a second slot and a third slot so that paper can be threaded through these slots and dispensed out of the housing.

2. Discussion of the Related Art

A number of attempts have been made to provide writing utensils that house a supply of paper. However, many of these writing utensils suffer from the drawback that the free end of the paper roll accidently withdraws back in through a slot in the housing. Some attempts have been made to prevent the paper from withdrawing back through the slot, including the use of complicated ratchet mechanisms. However, these mechanisms are cumbersome, expensive, awkward in use, and frequently break.

Accordingly, there is a need in the art for a writing utensil that houses a supply of paper that is simple and relatively inexpensive to manufacture, yet prevents the roll of paper from withdrawing into the housing.

It is a further object of the present invention to provide a writing utensil that houses a supply of paper and permits the leading edge of the roll of paper to be easily grasped for removal from the housing.

SUMMARY OF THE INVENTION

According to an exemplary embodiment of the present invention, the writing utensil includes a generally elongated hollow housing having a first longitudinal slot, a second longitudinal slot and a third longitudinal slot. A roll of paper is rotatably mounted within the housing. The roll of paper has a leading edge that is threadable out of the housing through the first slot, back into the housing through the second slot, and out of the housing through the third slot so that a selective portion of the roll of paper is removable from the housing.

It is a further object of the present invention to provide a writing utensil that houses a supply of paper and permits the leading edge of the roll of paper to be easily grasped for removal from the housing.

BRIEF DESCRIPTION OF THE DRAWING FIGURES

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein:

FIG. 1 is a perspective view of a writing utensil housing a supply of paper in accordance with a first embodiment of the present invention;

FIG. 2 is a partial-sectional view of the upper housing, connector and part of the lower housing;

FIG. 3 is a cross-sectional view taken along line 3—3 of FIG. 1 and looking in the direction of the arrows;

DETAILED DESCRIPTION OF THE PREFERRED EMBODIMENT

Figure 2A:
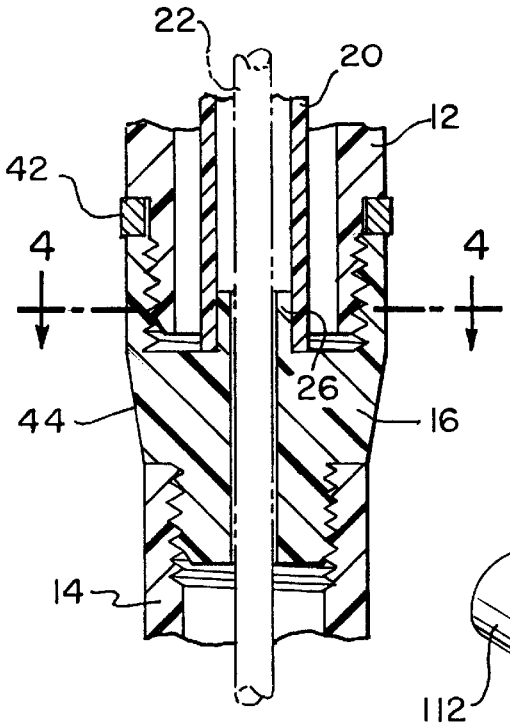
FIG. 2A is an enlarged cross-sectional view of FIG. 2 showing greater details of the connector.
Figure 4:
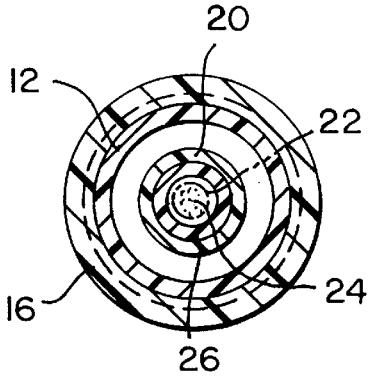
FIG. 4 is a cross-sectional view taken along lines 4—4 of FIG. 2A and looking in the direction of the arrows.

Referring now to FIGS. 1–4, a writing utensil 10, in accordance with a first embodiment of the present invention, is illustrated. The writing utensil includes an upper housing 12, a lower housing 14 and a connector 16. A supply of paper 18 in the form of a roll of is disposed within upper housing 12. The roll of paper 18 is wound about a core 20. A tube 22 is disposed radially within the roll of paper 18 and core 20. Tube 22 typically contains ink 24 so that the writing utensil can be used as a pen. Of course, the tube could contain lead so that the writing utensil can be used as a pencil. One skilled in the art will readily recognize that the utensil could also be, for example, a highlighter, a marker, etc.

Core 20, as illustrated in FIG. 2A, has its lower portion disposed radially about an upwardly projecting annular collar 26 of connector 16. Thus, core 20 is rotationally guided by annular collar 26 of connector 16 within the upper housing 12. If necessary, a similar collar may project downwardly from the upper portion of housing 12 to further rotatably support core 20.

Upper housing12 is a generally elongated hollow cylinder and has a first slot 28, a second slot 30 and a third slot 32. Each of the slots 28, 30 and 32 extend in the longitudinal axial direction of the cylindrical housing 12. As illustrated in FIG. 3, each slot is readily spaced apart from one another. As illustrated in FIG. 1, third slot 32 has a recess notch 34, which enlarges the size of slot 32. As illustrated in FIGS. 1 and 3, the roll of paper 18 has a leading edge 36 that is threadable out of housing 12 through first slot 28, back into housing 12 through second slot 30 and out of the housing 12 once again through slot 32. Thus, a selective portion of the roll of paper 18 can be removed from housing 12 as determined by the user. In this regard, recess 34 permits the finger or thumb of the user to grab a portion of the leading part of the roll of paper 18 so that the desired amount of paper can be pulled out of the housing. This predetermined amount of paper can then be pulled back against tear edge 38 of slot 32 to tear this portion of paper away from the roll of paper thereby forming a new leading edge 36 in the roll of paper 18. Of course, the paper could be provided with perforations to facilitate tearing, or could be formed of overlapping predetermined pieces of paper that separate one from another once disposed outside of third slot 32. As illustrated in FIG. 1, the recess 34 in slot 32 is formed for only a minority portion of slot 32. Recess 34 is sized so that a finger or pair of fingers can relatively easily grasp the leading part of the roll of paper.

To facilitate the threading of the paper in and out of the housing, first slot 28 is disposed at a first arcuate angle with respect to a tangent of the housing at the first slot. Additionally, the second slot 30 is disposed at a second arcuate angle with respect to a tangent of the housing at the second slot. As illustrated in FIG. 3, the arcuate angle of first slot 28 10 intercepts with the arcuate angle of second slot 30. Third slot 32 has a leading tear edge 38 and a trailing edge 40. Tear edge 38 is disposed at a third arcuate angle with respect to a tangent of the housing at the third slot. The second arcuate angle of second slot 30 is approximately parallel with respect to the third arcuate angle of the tear edge 38 of third slot 32.

As illustrated in greater detail in FIG. 2*a,* connector 16 is disposed between and threadably connected to each of the first upper housing 12 and second lower housing 14. In addition, a collar 42 is disposed between first housing 12 and connector 16. Collar 42 acts as a washer to help maintain the connection between first housing 12 and connector 16. In addition, connector 16 has a tapered portion 44 between its first axial end and its second end. Tapered portion 44 preferably includes an outer knurled surface to facilitate the user in grasping the connector to threadably connect the connector to housings 12 and 14.

To use writing utensil 10, the user would first remove upper housing 12 from the assembly of connector 16 and lower housing 14. A new roll of paper 18 and core 20 can then be placed about the upwardly projecting annular collar 26. The leading edge 36 of the roll of paper 18 can then be threaded through the first slot 28 and, thereby out of upper housing 12, back into the second slot 30, and out of the third slot 32. The upper housing 12 can then be threadably connected to connector 16 with collar 42 placed therebetween. Thus, a new roll of paper 18 is now ready to be dispensed from the writing utensil 10.

Figure 6:
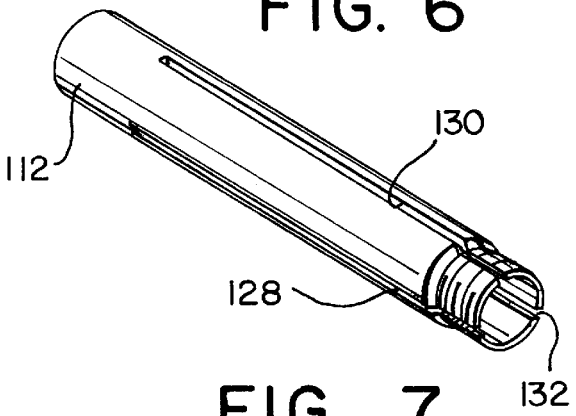
FIG. 6 is a perspective view of the upper housing of the writing utensil shown in FIG. 5.
Figure 5:
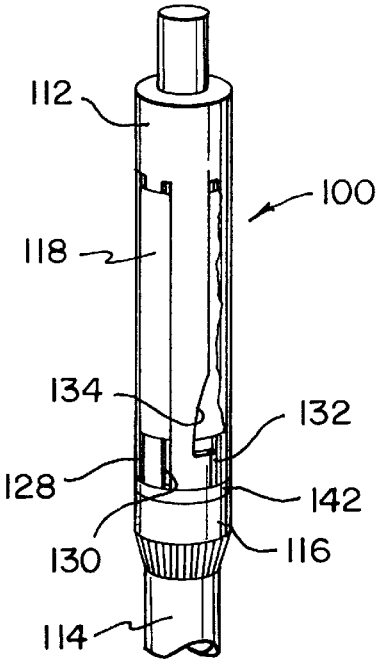
FIG. 5 is a perspective view of a writing utensil housing a supply of paper in accordance with a second embodiment of the present invention.
Figure 7:
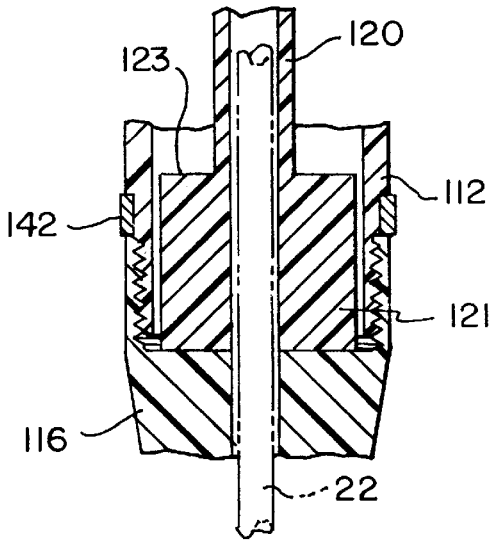
FIG. 7 is an enlarged cross-sectional view, similar to FIG. 2A, showing greater details of the connector.

Referring now to FIGS. 5–7, a writing utensil 100, in accordance with a second embodiment of the present invention, is illustrated. Writing utensil 100, in accordance with the second embodiment, is similar to the first embodiment and, therefore, like elements will be referred to with like reference numerals, with the addition of one-hundred, to the numeral. Additionally, many portions of the writing utensil in the second embodiment are identical to that in the first embodiment. Accordingly, for the sake of brevity, only those elements that are different in the second embodiment will be described.

Writing utensil 100 includes an upper housing 112, a lower housing 114 and a connector 116. A supply of paper 118 is wound about a core 120. A lower axial end of core 120 includes a radially enlarged shoulder portion 121. Radially enlarged shoulder portion 121 has an upwardly facing surface 123 that supports the roll of paper 118.

Upper housing 112 is a generally elongated hollow cylinder and has a first slot 128, a second slot 130, and a third slot 132. Each of slots 128, 130 and 132 extend in a longitudinal axial direction of the cylindrical housing 112. As illustrate in FIGS. 5 and 6, each slot is radially spaced apart from one another and extends to the lower axial end of the upper housing 112. Thus, each slot 128, 130 and 132 extends through the reduced diameter threaded portion of upper housing 112. Slot 132 preferably includes recessed notch 134 to permit the finger or thumb of the user to grab the portion of the leading part of the roll of paper 118 so that a desired amount of paper can be pulled out of the housing. Because slots 128, 130 and 132 now extend through the threaded portion of upper housing 112, the lower axial end of the upper housing 112 may tend to collapse. To compensate for the slots 128, 130, 132 extending to the axial end of the upper housing, core 120 includes the radially enlarged portion 121 to help prevent compression of the upper housing 112.

To use writing utensil 100, the user will first remove the upper housing 112 from the assembly, as illustrated in FIG. 6. A new roll of paper 118 can be fed, by its leading edge 136, through slots 128, 130 and 132 relatively easily because slots 128, 130 and 132 are accessible from one axial end of upper housing 112. Core 120 can then be placed within the new roll of paper 118 that has been placed within the upper housing 112. The upper housing 112 and core 120 can then be threadably connected to connector 116 with collar 142 placed therebetween. Thus, a new roll of paper 118 is now ready to be dispensed from writing utensil 100.

Having described the presently preferred exemplary embodiments of a writing utensil housing a supply of paper in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

What is claimed is:

1. A writing utensil comprising:

a generally elongated hollow housing having a first longitudinal slot, a second longitudinal slot and a third longitudinal slot;

a roll of paper rotatably mounted within said housing, said roll of paper having a leading edge that is threadable out of said housing through said first slot, back into said housing through said second slot, and out of said housing through said third slot so that a selective portion of said roll of paper is removable from said housing.

2. The writing utensil according to claim 1, wherein said first slot, said second slot and said third slot are radially spaced apart from one another.

3. The writing utensil according to claim 1, wherein said first slot, said second slot and said third slot are essentially parallel to one another.

4. The writing utensil according to claim 1, wherein said third slot includes a recess.

5. The writing utensil according to claim 4, wherein said recess extends for a minority portion of said third slot.

6. The writing utensil according to claim 1, further comprising a tube disposed radially within said roll of paper.

7. The writing utensil according to claim 1, wherein said first slot is disposed at a first arcuate angle with respect to a tangent of said housing at said first slot.

8. The writing utensil according to claim 7, wherein said second slot is disposed at a second arcuate angle with respect to a tangent of said housing at said second slot, said first arcuate angle intersecting with said second arcuate angle.

9. The writing utensil according to claim 8, wherein said third slot is defined by a leading tear edge and a trailing edge, said tear edge being disposed at third arcuate angle with respect to a tangent of said housing at said third slot, said second arcuate angle and said third arcuate angle being approximately parallel.

10. The writing utensil according to claim 1, further comprising a second generally cylindrical hollow housing, and a connector, said connector being disposed between and connected to each of said first housing and said second housing.

11. The writing utensil according to claim 10, wherein said connector is threadably connected to said first housing and to said second housing.

12. The writing utensil according to claim 11, further comprising a tube disposed radially within said roll of paper, said connector and said second housing.

13. The writing utensil according to claim 12, wherein said tube contains ink.

14. The writing utensil according to claim 11, further comprising a collar disposed between said first housing and said connector.

15. The writing utensil according to claim 11, wherein said connector has a first end, a second end and a tapered portion there between.

16. The writing utensil according to claim 15, wherein said tapered portion includes an outer knurled surface.

17. A writing utensil comprising:

a generally elongated hollow housing having a first longitudinal slot, a second longitudinal slot and a third longitudinal slot, each of said first slot, said second slot and said third slot extend to one axial end of said housing;

a roll of paper rotatably mounted within said housing, said roll of paper having a leading edge that is threadable out of said housing through said first slot, back into said housing through said second slot, and out of said housing through said third slot so that a selective portion of said roll of paper is removable from said housing.

18. The writing utensil according to claim 17, wherein said first slot, said second slot and said third slot are radially spaced apart from one another.

19. The writing utensil according to claim 17, wherein said first slot, said second slot and said third slot are essentially parallel to one another.

20. The writing utensil according to claim 17, wherein said third slot includes a recess.

21. The writing utensil according to claim 20, wherein said recess extends for a minority portion of said third slot.

22. The writing utensil according to claim 17, further comprising a tube disposed radially within said roll of paper.

23. The writing utensil according to claim 17, wherein said first slot is disposed at a first arcuate angle with respect to a tangent of said housing at said first slot.

24. The writing utensil according to claim 23, wherein said second slot is disposed at a second arcuate angle with respect to a tangent of said housing at said second slot, said first arcuate angle intersecting with said second arcuate angle.

25. The writing utensil according to claim 24, wherein said third slot is defined by a leading tear edge and a trailing edge, said tear edge being disposed at third arcuate angle with respect to a tangent of said housing at said third slot, said second arcuate angle and said third arcuate angle being approximately parallel.

26. The writing utensil according to claim 17, further comprising a second generally cylindrical hollow housing, and a connector, said connector being disposed between and connected to each of said first housing and said second housing.

27. The writing utensil according to claim 26, wherein said connector is threadably connected to said first housing and to said second housing.

28. The writing utensil according to claim 27, further comprising a tube disposed radially within said roll of paper, said connector and said second housing.

29. The writing utensil according to claim 28, wherein said tube contains ink.

30. The writing utensil according to claim 27, further comprising a collar disposed between said first housing and said connector.

31. The writing utensil according to claim 27, wherein said connector has a first end, a second end and a tapered portion there between.

32. The writing utensil according to claim 31, wherein said tapered portion includes an outer knurled surface.

* * * * *